United States Patent [19]

Chateau

[11] Patent Number: 4,856,830

[45] Date of Patent: Aug. 15, 1989

[54] DOOR BLOCKING DEVICE

[76] Inventor: Michel M. Chateau, 9, rue Louis David, 75016 Paris, France

[21] Appl. No.: 121,431

[22] Filed: Nov. 17, 1987

[30] Foreign Application Priority Data

Nov. 18, 1986 [FR] France ..... 86 16018

[51] Int. Cl.[4] ..... E05C 1/06

[52] U.S. Cl. ..... 292/254; 292/337

[58] Field of Search ..... 292/337, 254; 49/394, 49/395; 70/DIG. 64

[56] References Cited

U.S. PATENT DOCUMENTS

| | | | |
|---|---|---|---|
| 229,995 | 7/1880 | Freeman | 292/254 X |
| 1,479,744 | 1/1924 | Salata . | |
| 3,888,046 | 6/1975 | Meisterheim | 49/395 X |

*Primary Examiner*—Richard E. Moore

*Attorney, Agent, or Firm*—Lucas & Just

[57] ABSTRACT

A door blocking device comprises a bar, which extends along the edge of the door jamb, and a formed section for housing the bar, which formed section is fast with said edge and so shaped as to allow the bar to move, with only a small amount of friction, under the control of an actuating member, between a door blocking position and a door releasing position. The bar is equipped with means for returning it to the blocking position, and the actuating member drives it against the returning force in order to bring it in the releasing position. The blocking bar is equipped with a locking device comprising an elongated flat rod which, by a pivoting movement under the action of return springs, takes up a slanted position behind the bar and locks it in the door-blocking position. The bar actuating member can drive said bar back to the releasing position after controlling the retraction of the flat rod by means of a bent lever pivoting through the bar.

10 Claims, 2 Drawing Sheets

DOOR BLOCKING DEVICE

FIELD OF THE INVENTION

The present invention relates to a device for blocking a door constituted by an openable panel mounted opposite a door frame or jamb and comprising an edge which, when the door is in closed position, is situated in facing relationship to a conjugate edge of the door frame or jamb, and which, when the door opens, moves away from the latter edge in a direction substantially perpendicular to the plane of the door; this device is essentially composed of a bar extending along the aforesaid edge of the door frame, through most of the length thereof, and of a formed section for housing said bar, which formed section is fast with said latter edge and is so shaped as to prevent the bar from moving perpendicularly to the plane of the door in closed position, while allowing it to move, with only a small amount of friction, under the control of an actuating mechanism, according to a translatory movement in parallel to itself, between a blocking position in which it emerges laterally from the formed section to overlap the gap between the said edges, and a releasing position in which it retracts into the formed section while uncovering said gap and, as a result, permitting the opening of the door, the bar being equipped with means for returning it to the blocking position, so that the actuating mechanism drives the bar against the restoring force to bring same in the releasing position.

Door blocking devices are often required to be locked when they are in their blocking position, in order to prevent anyone, who has found a way of entering the area protected by the door without coming through the latter, from opening said door by direct action on the blocking device to bring it to the releasing position, hence opening it.

SUMMARY OF THE INVENTION

To overcome the aforesaid problem, the present invention proposes a device for locking in position the blocking bar of the above-described device.

Such locking device comprises a blocking member which is adapted to be placed in an active position in which it locks the bar in the blocking position, or in an inactive position in which the bar is released, said locking device being so designed that its blocking member has priorly been placed in inactive position by the bar actuating mechanism when said mechanism operates to drive the bar to its releasing position.

The blocking member is preferably provided with restoring means which, when the bar resumes the blocking position, automatically returns it to active position.

According to one advantageous embodiment, in which means are provided for guiding the bar into the formed section while creating a gap between at least one of the walls of the formed section and the opposite face of the bar, the blocking member is constituted by a long flat rod which extends through substantially the whole height of the bar and can pivot of a small angle about one of its longitudinal edges resting against the bottom of the formed section, between an inactive position in which it is retracted in said gap, leaving the bar to move freely, and an active blocking position in which its second longitudinal edge is placed behind the bar in blocking position such as to block the latter by a bracing function between the bottom of the formed section and the rear face of the bar.

Given that the bar actuating mechanism controls the bar displacements through a movable member adapted to come and exert a pressure on the front face of the bar with the object of driving the latter back towards the bottom of the formed section, arrangements should be made so that the pivoting movement of the flat rod from its active position to its inactive position is controlled by a lever bent substantially at right angle, and so that said lever, which is pivotable about an axis joined to the bar and parallel to the bar longitudinal direction, comprises a first arm of which the end is contiguous to the second edge of the flat rod and a second arm of which the end is interposed between the front face of the bar and the movable member used for actuating said bar, in order that said member, when moving to drive the bar to its releasing position, causes first the bent lever to pivot, which lever then controls, by the end of its first arm, the pivoting movement of the flat rod toward its retracted position.

According to another feature of the invention, the first arm of the bent lever traverses the bar through an orifice provided in its front face, namely the face closest to the openable panel of the door, of cross-section hardly larger than that of said arm, said orifice being near the arm pivoting axis, and through an orifice provided in its rear face, and being wide enough to allow the pivoting movements of the bent lever.

Preferably, the second arm of the bent lever is wider in the longitudinal direction of the bar, than the first arm and connects up with the latter by way of a pair of symmetrical shoulder pieces by which the bent lever rests against the front face of the bar, on either side of the orifice provided in said face.

It is recommended to select, for each particular case of application, the disposition of the bent lever which offers the best security, as regards possible illegal actuating thereof. For example, and depending on the case, the second arm of the bent lever can be oriented either in the direction of the door opening movement, or, on the contrary, in the direction of the door closing movement. Moreover, an obstacle can advantageously be provided close to the end of the second arm of the bent lever, to prevent the access to the face thereof which is opposite the bar when said bar is in blocking position.

When a second movable member is provided for actuating the bar, the dimensions of the second arm of the bent lever should be such that it can be engaged by either one of the two actuating members.

BRIEF DESCRIPTION OF THE FIGURES

The invention will be more readily understood on reading the following description with reference to the accompanying drawings, in which.

DETAILED DESCRIPTION OF THE INVENTION

Figure 1:
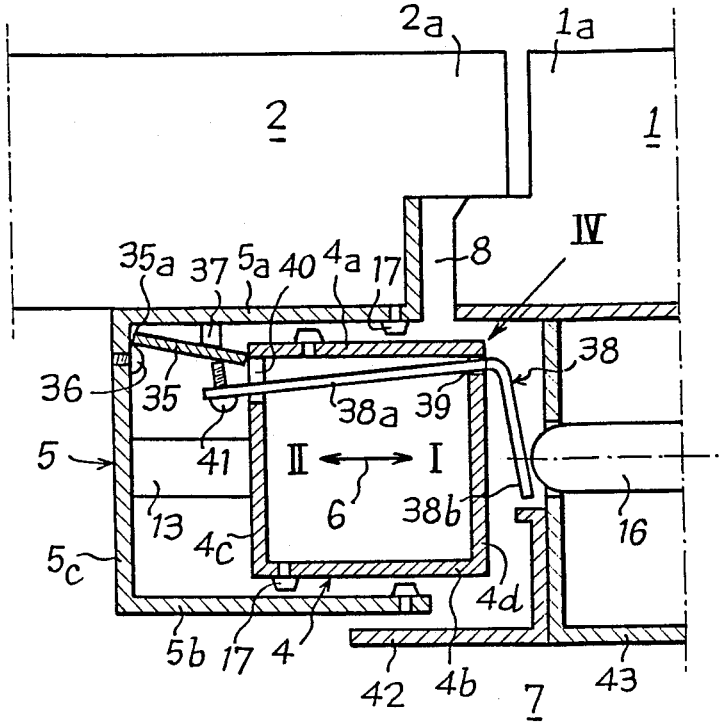
FIG. 1 illustrates a cross-section along a horizontal plane of a door blocking device with movable bar equipped with a locking device according to the present invention, the bar being locked in the blocking position.
Figure 3:
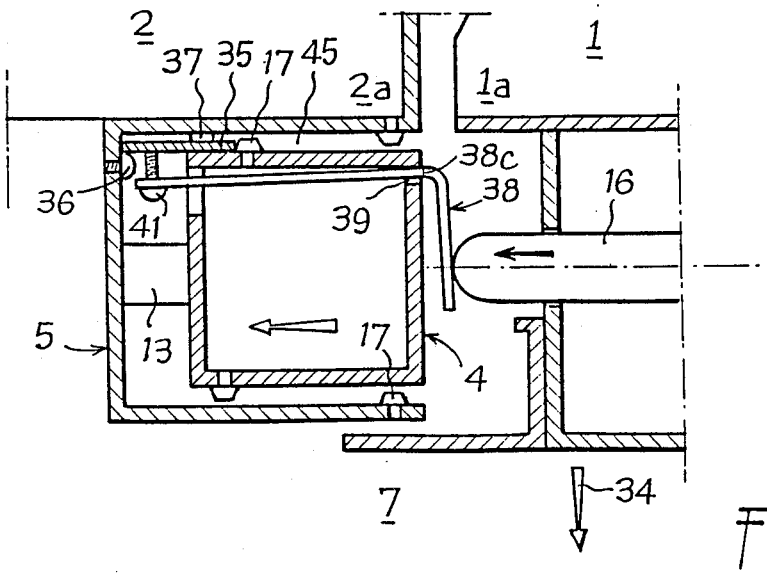
FIGS. 2 and 3 illustrate the object of FIG. 1, in respectively, the case where the bar is unlocked, and the case where said bar has been brought to the releasing position.
Figure 2:
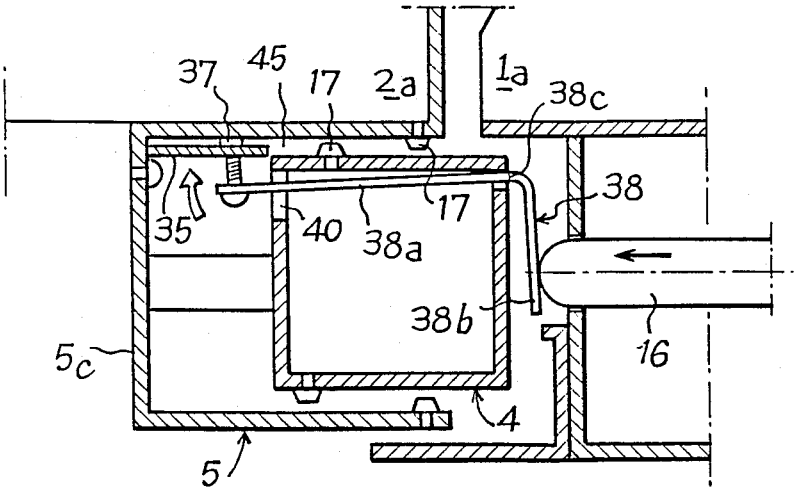

Referring now to FIGS. 1 to 3, these show the conjugate edges 1*a*, 2*a* of a door 1 and of the door jamb 2 in which said door is mounted and can pivot about a vertical pivoting axis. Said door is equipped, on the inner side 7 corresponding to the room which the door is designed to close, with a blocking device essentially composed of a bar 4 movable inside a formed section 5 fixed to the door jamb 2, both these elements extending vertically along the edge 1*a* of the door, opposite to its pivoting axis, which the conjugate edge 2*a* of the door jamb faces, when the door is in closed position, as in the illustrated example. The bar 4, which is formed by a rectilinear metal tube of square cross-section, can move while being guided inside the formed section which is U-shaped, following a horizontal translatory direction 6 parallel to the plane of the panel forming the door 1, in order to reach either a door-blocking position I (FIGS. 1 and 2), or a door-releasing position II (FIG. 3).

In its door-blocking position I, the bar 4 emerges from the U-section 5 housing it, to reach a position in front of the gap 8 separating edges 1*a* and 2*a* on the inner side 7. In such a case, door 1 cannot be opened, its edge 1*a* being stopped by the face 4*a* of the bar 4 parallel to the plane of the door and closest to said door, whereas the bar comes to rest, over its entire length, which latter is only a little shorter than the height of the door, by its opposite face 4*b* against the contiguous flange 5*b* of the U-section 5. In the event of a thrust force being exerted from the outside, the bar 4 being under compression between the flange 5*b* of the U-section 5 and the edge 1*a* of the door, prevents the opening of the latter.

In its door-releasing position II, the bar 4 is retracted inside the U-section 5 (FIG. 3), and thus it no longer prevents the edge 1*a* of the door from moving towards the inner side 7, and the door can be opened according to arrow 34.

The bar 4 is supported at its lower end by a device which enables it to move between its position I and II without undergoing any noticeable frictions. Moreover, sliding studs 17 are distributed over faces 4*a* and 4*b* and over the corresponding faces 5*a* and 5*b* of the U-section 5, in order to reduce friction between the bar and the U-section. Leaf springs 13 are placed between the bottom 5*c* of the U-section 5 and the opposite face of the bar 4 so that said bar is subjected, through its entire length, to a restoring force returning it towards its blocking position I.

The bar 4 can be placed in its releasing position II by means of a lock provided with a movable driving rod, adapted to push the bar backward and to cause it to retract into the U-section 5 (FIG. 3), while compressing the springs 13. Door 1 can then be opened freely.

In its blocking position I (FIG. 1), the bar 4 is blocked by a locking device which prevents it from moving to its releasing position II, in the event that a thrusting force is applied directly on the bar itself. This locking device comprises an elongated flat rod 35, pivotable about its longitudinal edge 35*a* applied against the bottom 5*c* of the U-section 5 and held in position by the screws heads 36 forming stops, in the angle formed by said bottom with the face 5*a* of the U-section 5 adjacent the door jamb 2. Under the action of restoring springs 37, the flat rod 35 adopts a slanted position (FIG. 1) in which, being placed behind the bar 4, it can block said bar by a bracing operation, between its rear face 4*c* and the bottom 5*c* of U-section 5.

The locking device further comprises a bent lever made-up of two arms 38*a*, 38*b*, forming substantially a right angle. The first arm 38*a* traverses the bar through orifices 39, 40 formed respectively in the front face 4*d* and in the rear face 4*c* thereof. The front orifice 39 is barely wider than the arm 38*a*, whereas the rear orifice 40 is noticeably wider and offers a horizontal clearance possibility to said arm, so that the bent lever 38 can pivot about a horizontal axis situated near the orifice 39. As to arm 38*b*, this is interposed between the front face 4*d* of the bar and the movable driving rod 16.

Figure 4:
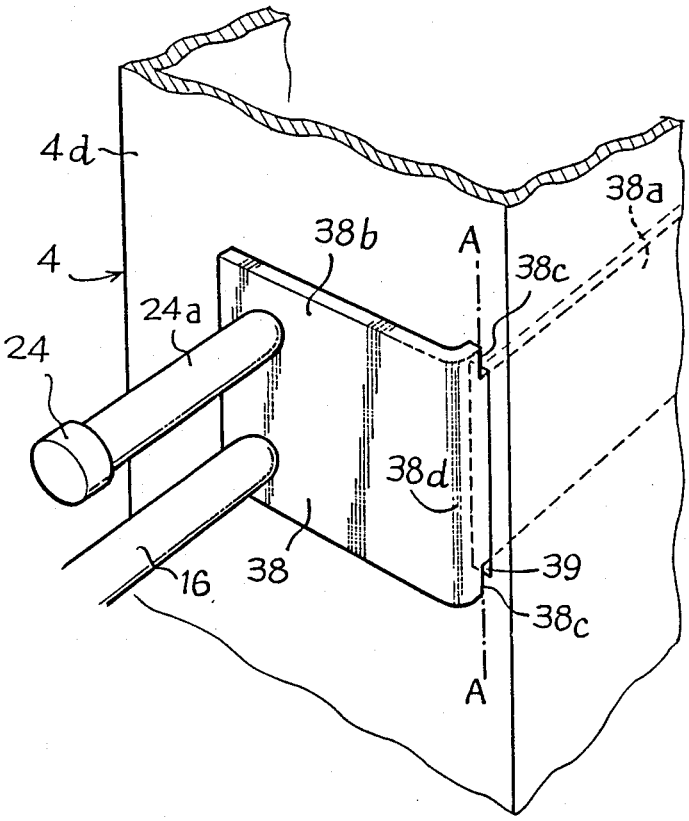
FIG. 4 illustrates a simplified perspective view of the detail IV shown in FIG. 1.

The bent lever 38 is constituted by a strip of sheet metal, thin but rigid and bent at right angle. As illustrated in FIG. 4, its arm 38*b* is wider than its arm 38*a* to which it is connected via a pair of aligned shoulders 38*c* situated close to the bending line 38*d* of the bent lever 38, between said line and the end of arm 38*a*. The two shoulders 38*c* by which the bent lever 38 can rest on the front face 4*d* of the bar 4, above and under orifice 39 (formed by a narrow vertical slot), define the pivoting axis AA of the bent lever.

At its end emerging from the bar 4 through orifice 40, arm 38*a* is provided with a screw 41 which cooperates with flat rod 35, the end of said screw being applied against the lateral face of said rod situated opposite the springs 37, in a point remote from the edge 35*a* about which said rod is pivotable.

In order to bring the bar 4 from its blocking position I, where it is locked by the flat rod 35 (FIG. 1), to its releasing position II permitting the opening of the door 1 (FIG. 3), the driving rod 16 is caused to move toward bar 4 by operating the lock. Said driving rod encounters the arm 38*b* of the bent lever 38*a* and causes it (FIG. 2) to pivot about its pivoting axis AA materialized by shoulders 38*c*. The screw 41 placed at the end of arm 38*a* then causes the flat rod 35 to pivot, which latter retracts in parallel to the lateral face 5*a* of the U-section 5, in the gap 45 created by the studs 17 between said face and face 4*a* opposite the bar 4, while compressing its restoring springs 37, so that it stops preventing the bar 4 from moving backward to the bottom 5*c* of the U-section 5. By continuing to move forward, the driving rod 16 drives the bar 4 back, via the bent lever 38, as far as its releasing position II (FIG. 3) where said bar 4 holds the flat rod 35 in retracted position in the gap 45, independently of the lever 38.

When, after the door is closed again, the bar 4 returns to its blocking position II, it releases the flat rod 35 and the latter, under the action of springs 37, pivots to resume automatically its active bar-blocking position (FIG. 1).

To prevent anyone with wrong intentions, situated on the inner side 7 of the door, from succeeding in unlocking the bar 4 by direct action on the bent lever 38, the access to arm 38*b* of the latter is prevented by a fitting 42 fixed to the casing 43 of the lock. The shape of said fitting is such that, when the door is closed (FIG. 1), said fitting on the one hand covers part of the edge of the lateral face 5*b* of the U-section 5 facing toward the inner side 7, and this at least at the lever of the bent lever 38, and on the other hand, it conceals the end of arm 38*b*, so as to prevent the introduction of a house-breaking tool as far as the face of that arm facing toward the driving rod 16.

In the illustrated embodiment, the device 35, 38 for locking the bar 4 is placed close to the lateral face 4*a* of said bar which is opposite to the inner side 7, arm 38*b* of bent lever 38 emerging from bar 4 toward the door opening direction 34. A symmetrical disposition could also be adopted, if necessary, in which the flat rod 35, the arm 38*a* and the orifices 39, 40 would be situated close to the other lateral face 4*b* of bar 4, arm 38*b* being oriented in the direction opposite the door opening direction 34.

It is also possible to provide, besides the driving rod 16 which is operated with a lock, a handle 24 comprising an actuating rod 24*a*, permitting a direct action on the bar 4, independently of the lock, —but of course, only on the inner side 7. Actuating rod 24*a*, similar to rod 16, is then placed at another level than rod 16, and arm 38*b* extends sufficiently in vertical direction to be reachable by either one of the two rods, as illustrated in FIG. 4.

What is claimed is:

1. A blocking device for use with a door which comprises an openable panel having an edge mounted opposite a door jamb having an edge, a gap between the openable panel edge and the door jamb edge when said door is in the closed position, said blocking device comprising:

a bar which extends vertically along a length of said door jamb edge; a formed section having walls for housing said bar, said formed section being fixed with respect to said door jamb edge and being L-shaped with respect to the door jamb to prevent the bar from moving perpendicularly to the plane of said openable panel when said openable panel is in its closed position, the L-shape comprising two walls, one wall of which extends out perpendicularly from the door jamb and the other wall of which extends from the end of said one wall parallel to the said plane of said openable panel; said bar being movable parallel to the plane of said door by an actuating device; said actuating device moving said bar between a blocking position in which said bar extends laterally from said formed section and overlaps said gap between said edges, and a releasing position in which said bar retracts into the formed section thereby uncovering said gap and permitting opening of said door; said bar having resilient means for returning it to the blocking position; and a locking device comprising a blocking member which is in an active position to lock said bar in place when said bar is in its blocking position, and is movable to an inactive position by said actuating device, said locking member in its active position being situated in said formed section between said bar and said other wall of the L-shape.

2. Device as claimed in claim 1, wherein said blocking member is equipped with return means which, when said bar returns to the blocking position, replaces said blocking member automatically in active position.

3. Device as claimed in claim 1, wherein means are provided for guiding said bar in said formed section, which means create a gap between at least one of the walls of said formed section and a face of said bar, and said blocking member comprising an elongated flat rod which extends through substantially the whole length of said bar, said flat rod having first and second longitudinal edges in opposed position, and being pivotable about said first longitudinal edge, said first longitudinal edge resting against said other wall of the formed section, between an inactive position in which said flat rod is retracted into said gap, leaving said bar free to move, and an active blocking position in which said second longitudinal edge is behind said bar in blocking position.

4. Device as claimed in claim 3, wherein said bar has a front face, the bar actuating device controls the displacement of said bar by means of a movable member adapted to exert a pressure on said front face of said bar in order to drive said bar toward a wall of said formed section, the pivoting movement of said flat rod from its active position to its inactive position being controlled by a lever bent substantially at a right angle, said lever being pivotable about an axis parallel to the actuating device.

5. Device as claimed in claim 4, wherein said bar has a front orifice in its front face and a rear orifice in its rear face, said first arm of said bent lever extending through said front orifice, said front orifice having a cross-section slightly larger than the cross-section of said arm, said front orifice being near said pivoting axis, and through said rear orifice being wide enough to allow pivoting movement of said bent lever.

6. Device as claimed in claim 5, wherein said second arm of said bent lever is wider in the longitudinal direction than said first arm, said second arm having a pair of symmetrical shoulders and being connected to said first arm.

7. Device as claimed in claim 4, wherein said second arm of said bent lever is oriented in the direction of the door opening movement.

8. Device as claimed in claim 4, wherein said second arm of said bent lever is oriented in the direction of the door closing movement.

9. Device as claimed in claim 4, wherein said second arm has a face and an obstacle is provided close to said end of said second arm of said bent lever, in order to close the access to said face of said second arm situated opposite said bar when said bar is in blocking position.

10. Device as claimed in claim 4, wherein a second movable member is provided for driving said bar, and said second arm of said bent lever is so dimensioned that it can be driven by either said first movable member or said second movable member.

* * * * *